United States Patent [19]

Jouillat

[11] Patent Number: 4,944,432

[45] Date of Patent: Jul. 31, 1990

[54] APPARATUS FOR FACILITATING THE FILLING OF SPRAY DEVICES

[75] Inventor: Claude Jouillat, Montigny sur Avre, France

[73] Assignee: S.T.E.P., Sur-Aure, France

[21] Appl. No.: 301,789

[22] Filed: Jan. 26, 1989

[30] Foreign Application Priority Data

Feb. 5, 1988 [FR] France ..... 88 01367

[51] Int. Cl.[5] ..... B05B 11/00

[52] U.S. Cl. ..... 222/321; 141/3; 141/20; 222/385

[58] Field of Search ..... 222/321, 372, 383, 385, 222/402.16; 239/333; 141/3, 20, 2, 21, 27, 26

[56] References Cited

U.S. PATENT DOCUMENTS 4,025,046 5/1977 Boris ..... 222/321 X
4,089,442 5/1978 Hafele et al. ..... 222/385 X
4,122,982 10/1978 Giuffredi ..... 222/321
4,173,297 11/1979 Pettersen ..... 222/385 X
4,389,003 6/1983 Meshberg ..... 222/321

FOREIGN PATENT DOCUMENTS 2305241 10/1976 France .

*Primary Examiner*—Kevin P. Shaver

[57] ABSTRACT

An apparatus for facilitating the filling of a spray device, the spray device being constituted by a receptacle and an extraction and projection pump mounted on the receptacle. The pump is of the precompression type and includes a valve member (8) having a pin (9) which is held pressed against a seat (7) by a spring (10) whose characteristics determine the degree of precompression. The seat is formed around the axis of the delivery piston (4) of the pump, and wherein breakable or deformable projections (15) are formed on the valve member suitable for holding the valve open so long as said projections are not destroyed or deformed.

5 Claims, 2 Drawing Sheets

APPARATUS FOR FACILITATING THE FILLING OF SPRAY DEVICES

The present invention relates to apparatus for facilitating the filling of spray devices.

BACKGROUND OF THE INVENTION

The term "spray devices" is used in general to cover an assembly constituted by a receptacle and a pump mounted on the receptacle for extraction and projection purposes. The invention relates more particularly to such spray devices in which the pump is of the precompression type including a needle valve having a spring holding it against its seat which is formed on the axis of a delivery piston, with the characteristics of the spring determining the amount of precompression. One such pump is described, for example, in American Pat. No. 4,025,046 and in French patent number 2,305,241.

In such a spray device, as increasing quantities of the substance to be sprayed are expelled, the volume previously occupied thereby is generally filled With air. However, with some substances, e.g. perfumes and medicines, contact with air must be avoided. In such cases, a gas, such as nitrogen for example, is inserted under pressure into the receptacle (which is deliberately only partially filled with the substance to be sprayed in order to leave room to receive the gas). As the substance is sprayed out, the nitrogen expands and occupies the volume left empty. This opposes the penetration of air into the receptacle. In addition, pump priming and filling are enhanced. A difficulty consists in injecting the nitrogen after the receptacle has been filled with liquid and the pump has been crimped onto the receptacle.

Various different means and methods have already been proposed for injecting gas into the receptacle. The methods used suffer from drawbacks, due above all to the length of time taken by the gas filling operation, and also to the size of the machines used for performing the methods.

The present invention seeks to provide simple means enabling a receptacle having a precompression pump crimped thereon to be rapidly filled or emptied, with gas or with liquid. The idea is to provide a pump with apparatus for ensuring that a fluid (a gas, a liquid, a paste, etc.) can flow either from the outside towards the inside of the container or from its inside towards its outside, with the path used for that purpose being permanently shut off either on the first occasion that the piston is actuated, or else by some other external action.

SUMMARY OF THE INVENTION

More precisely, the present invention provides an apparatus for facilitating the filling of a spray device, the spray device being constituted by a receptacle and an extraction and projection pump mounted on the receptacle, wherein the pump is of the precompression type including a valve member having a pin which is held pressed against a seat by a spring whose characteristics determine the degree of precompression, said seat being formed around the axis of the delivery piston of the pump, and wherein breakable or deformable projections are formed on the valve member suitable for holding the valve open so long as said projections are not destroyed or deformed.

Advantageously, the valve member is made of molded plastic material and the projections are constituted by lugs which are integrally molded therewith. The lugs are disposed at locations such that they oppose application of the valve member against its seat which is formed on the piston. The lugs are dimensioned so as to able to withstand a given force, e.g. 1.5 kg, but so that they are crushed or broken or permanently deformed when some greater force is applied, e.g. 2.5 kg or more.

For example, this principle makes it possible to:

Case 1: fill a liquid to be expelled at low pressure with a propellant gas.

Case 2: bleed off the air or gas in a flexible container after its pump has been permanently fixed thereto (with the pump mechanism preventing reverse air flow and thus providing complete protection for the substance contained in the container).

Case 3: fill a container directly with a gaseous mixture.

In order to implement Case 1, above:

(a) the pump (taken directly from the factory where it is manufactured) is crimped as manufactured on the desired container as though it were a conventional valve; and (b) the propellant gas is loaded into the container via a standard head having a central piston for thrusting against the valve member (or piston) of the pump after filling has been completed in order to permanently deform three (or more) safety lugs which provided the filling path for the propellant gas.

BRIEF DESCRIPTION OF THE DRAWINGS

Embodiments of the invention are described by way of example with reference to the accompanying drawings, in which.

MORE DETAILED DESCRIPTION

Figure 1:
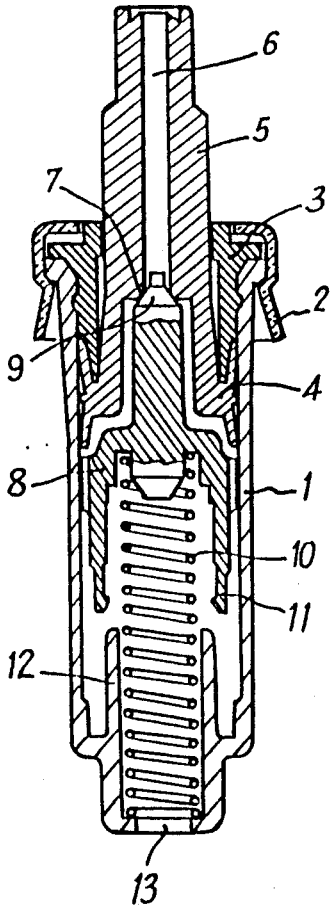
FIG. 1 is a section view through a precompression pump to which the present invention can advantageously be applied.

The precompression pump shown in section in FIG. 1 comprises a pump body 1 suitable for fixing to the neck of a receptacle (not shown) by means of a capsule 2 which also serves for crimping the end plate 3 onto the pump body. The body and the end plate are made of plastic materials chosen to provide good sealing where they meet. The pump also includes a piston 4 controlled by a hollow rod 5 which includes an internal delivery channel 6. The piston rod passes through the end plate 3 in order to enable the piston to be controlled from outside. The channel 6 opens out into the pump body in the middle of the piston by forming a valve seat 7. A valve member 8 is slidably mounted inside the pump body. At its top end it includes a pin 9 for pressing against the seat 7 in sealed manner. A spring 10 urges the valve member upwards in order to close the valve, and also serves as a piston return spring. The valve member has a downwardly directed skirt 11 which, whenever the valve member moves downwards, covers a cylinder 12 fixed to the pump body, thereby closing the pump chamber when the piston is pushed down.

The pump body has a suction opening 13 at its bottom end, which opening may be extended by a dip tube.

Such a pump is well known, in particular from the patents mentioned above. Apart from the spring and the capsule, all of its components are made of plastic material. The plastic materials used for the various parts are selected so as to provide the desired degrees of sealing and sliding. In the rest state, the assembly is in equilibrium as shown in FIG. 1. For example, it may be assumed that the pump is crimped onto a receptacle after the receptacle has been partially filled with liquid. If gas is then to be injected into the receptacle, the valve member must be opened. It is not possible in practice to open the valve member merely by suitably raising the pressure of the gas to be inserted in the channel 6 since the cross-section of the channel 6 is very small (about one square millimeter), and the corresponding gas pressure would be several hundred bars, which is unsuitable for use when the pressure at which the gas should be inserted into the receptacle is no more than a few bars. As a result, needles are used which are inserted into the channel 6 in order to lift the pin 9 off its seat prior to injecting the gas. Suitable machines for performing these operations are complicated and expensive.

Figure 2:
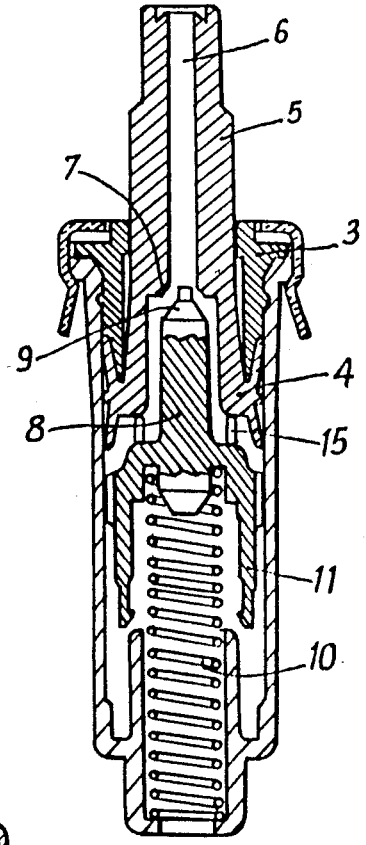
FIG. 2 is a view analogous to FIG. 1, but showing a pump which has been modified in accordance with the present invention by having lugs formed on its valve member, with the pump being shown in its rest state.

In an embodiment of the invention, the valve member 8 is integrally molded with lugs 15 (FIG. 2) which, in the rest state, hold the pin off its seat, without causing the skirt 11 to fit over and close the cylinder 12. Thus, in the state shown in FIG. 2, it is easy to insert a fluid into the receptacle.

Figure 3:
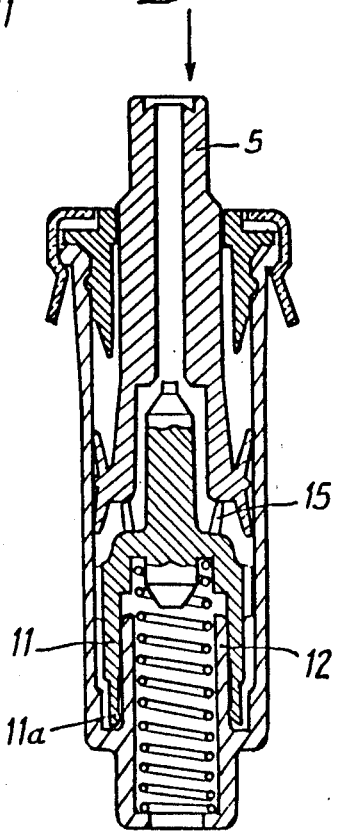
FIG. 3 shows the FIG. 2 pump with the piston of the pump being lowered at the end of its compression stroke prior to having its lugs crushed.
Figure 4:
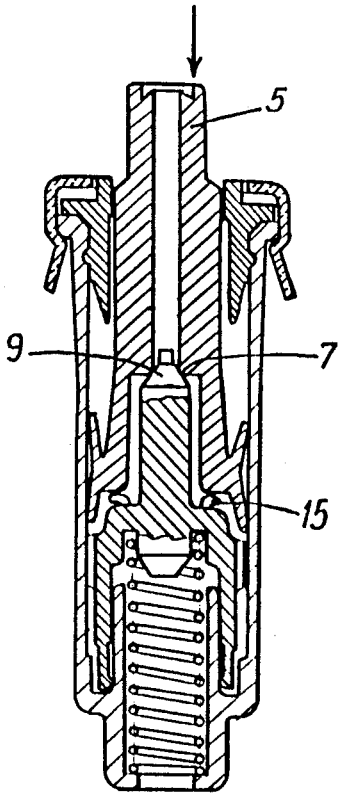
FIG. 4 shows the same pump after its lugs have been crushed.

Indeed, the disposition provided by these lugs also makes it possible to inject a liquid into the receptacle as well as making it possible to take a liquid out therefrom, e.g. for the purpose of emptying a flexible receptacle of air which is intended, in operation, to contain only a liquid or a paste, without any air being present, or else to suck out any residual air contained in a receptacle after it has been filled with liquid for the purpose of replacing it with some other gas, such as nitrogen After filling, or some other finishing operation, the lugs 15 are deformed or broken. This is done by pushing the piston rod 5 into the receptacle until the bottom edge ll*a* of the skirt 11 reaches the bottom of the circular groove surrounding the base of the cylinder 12 (FIG. 3) or, depending on the shapes and sizes of the valve member and of the cylinder, until the bottom of the valve member comes into abutment against the top edge of the cylinder (not shown). Increased pressure is then exerted in order to crush and/or impart permanent deformation to the lugs (FIG. 4) so that the pin 9 of the valve can engage the seat 7 in the middle of the piston in sealed manner. Thereafter no further pressure needs to be exerted on the rod 5 and the assembly returns to a rest position in which the valve is now closed.

Figure 5:
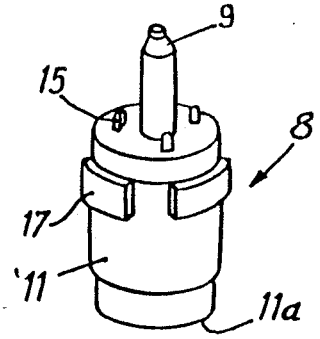
FIG. 5 is a perspective view of the valve member of FIGS. 2 to 4.

FIG. 5 is a perspective view of a valve member 8 for a pump in accordance with the present invention. This figure shows the lugs 15 and the ribs 17 used for centering the valve member and for ensuring that it slides axially while leaving a fluid passage between the skirt of the valve member and the inside cylindrical wall of the pump chamber.

Figure 6:
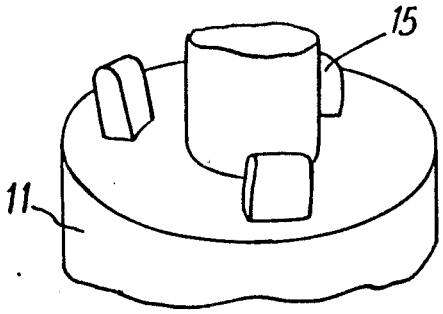
FIG. 6 is an enlarged view of a portion of FIG. 5.
Figure 7:
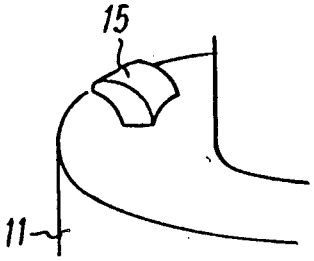
FIG. 7 is a detailed view of FIG. 6 after a lug has been crushed.

FIG. 6 is on a larger scale and shows one example of a suitable shape for the lugs 15, and FIG. 7 shows a lug 15 after it has been deformed. In a variant, a line of weakness may be provided at the base or in the vicinity of the base of each lug in order to facilitate folding and/or breaking of the lug.

I claim:

1. Apparatus for facilitating the filling of a spray device, the spray device being constituted by a receptacle and an extraction and projection pump mounted on the receptacle, wherein the pump is of the precompression type and comprises a body, a delivery piston disposed within said body and movable along an axis, a valve member having a pin which is operable between a valve open position and a valve closed position in which that pin is held pressed against a seat by a spring whose characteristics determine the degree of precompression, said seat being formed around the axis of the delivery piston of the pump, the improvement comprising:

projections formed on the valve member and in contact with said piston for holding the valve in an open position.

2. Apparatus according to claim 1, wherein the valve member is made of molded plastic material and the projections are constituted by lugs which are integrally molded therewith.

3. Apparatus according to claim 2, wherein the lugs includes respective lines of weakness near their bases.

4. Apparatus of claim 1 wherein said projections have at least one of a breakable structure and a deformable structure.

5. Apparatus of claim 4 wherein said valve is maintained in an open position so long as said projections are not destroyed or deformed.

* * * * *